US006164668A

United States Patent [19]

Majeski

[11] Patent Number: 6,164,668

[45] Date of Patent: Dec. 26, 2000

[54] HYDRAULIC BRAKE FOR AN IN-LINE SKATE

[76] Inventor: Bruce Douglas Majeski, 54756 Bonnethill Trail, Mishawaka, Ind. 46545

[21] Appl. No.: 09/470,493

[22] Filed: Dec. 22, 1999

[51] Int. Cl.[7] ..... A63C 17/14

[52] U.S. Cl. ..... 280/11.2; 188/72.4; 188/17; 280/11.202

[58] Field of Search ..... 280/11.2, 11.19, 280/11.22, 11.23, 11.3; 188/72.4, 17, 4 R, 32

[56] References Cited

U.S. PATENT DOCUMENTS

| | | | |
|---|---|---|---|
| 4,295,547 | 10/1981 | Dungan | 188/72.4 |
| 5,320,367 | 6/1994 | Landis | 280/11.2 |
| 5,340,131 | 8/1994 | Smathers et al. | 280/11.2 |
| 5,358,078 | 10/1994 | Gagek et al. | 188/72.4 |
| 5,465,984 | 11/1995 | Pellegrini, Jr. et al. | 280/11.2 |
| 5,590,889 | 1/1997 | Pozzobon | 280/11.2 |
| 5,752,707 | 5/1998 | Cottle et al. | 280/11.2 |
| 5,772,221 | 6/1998 | Daley | 280/11.2 |
| 5,794,950 | 8/1998 | Svensson et al. | 280/11.2 |
| 5,803,468 | 9/1998 | Petrucci et al. | 280/11.22 X |
| 6,010,136 | 1/2000 | Hoskin | 280/11.2 |

*Primary Examiner*—Brian L. Johnson
*Assistant Examiner*—Bryan Fischmann
*Attorney, Agent, or Firm*—Leo H McCormick, Jr.

[57] ABSTRACT

A braking system for a pair of in-line roller skates having a housing with a plurality of rollers located one behind the other along a line of directional travel of the skate from a front end to a rear end. First and second rotors are secured to at least one of the plurality of the rollers. First and second pistons retained in the housing are located in a line perpendicular to the first and second rotors. An actuation piston is located in the housing and connected by first and second passageways to the first and second pistons. A boot which is secured to the housing has a pivotally attached collar located adjacent an opening for the foot of a skater. The collar engages an ankle of a skater for retention of the boot on a foot of the skater. A linkage extends from the collar to the actuation piston. When the skater is traveling in a forward direction, a center of gravity through which weight is transmitted from the boot into the housing is located toward the front end of the housing. This center of center of gravity is shifted from the front end toward the rear end of the housing by the skater moving toward an erect position. As the skater moves toward the erect position, the collar pivots with respect to the boot to provide the linkage with an input force which moves the actuation piston in the housing. Movement of the actuation piston in the housing creates a hydraulic pressure which is simultaneously supplied to move the first and second pistons into engagement with the first and second rotors to brake the roller.

16 Claims, 2 Drawing Sheets

HYDRAULIC BRAKE FOR AN IN-LINE SKATE

This invention relates to a hydraulic brake for use in an in-line roller skate which is manually actuated by an operator moving from a crouch position to an upright position to provide an input which moves a piston to develop an output force to simultaneously activate first and second parallel disc brakes associated with at least one wheel in the roller skate.

BACKGROUND OF THE INVENTION

In-line roller skates are characterized by a plurality of rollers mounted adjacent the bottom of a shoe or boot situated one behind one another along a directional line of travel of the skate, examples of such in-lines skates are illustrated in the following U.S. Pat. Nos. 5,052,701; 5,028,058; 5,280,930 and 5,253,883. The use of in-line roller skates has recently increased as a popular way of getting exercise however a common problem for all in-line roller skates is slowing down and in particular when traveling down steep hills such as experienced in cities such as San Francisco and Seattle. Some early developed in-line roller skates relied on positioning the skates in a manner such as skiing but this was not very successful and as a result a drag brake of the type disclosed in U.S. Pat. Nos. 5,052,701 and 5,253,883 were added to in-line roller skates.

Drag brakes offer a way of stopping but totally rely on the frictional engagement of a pad with a skating surface and as a result a skater does not always have sufficient control to achieve a stop within a desired time. U.S. Pat. No. 5,280,930 discloses a brake system with a hand held hydraulic actuator which is actuated squeezing a lever to supply a piston with pressurized fluid to move a brake pad into engagement with a side wall of the roller to reduce the rotation of the roller. Such a system offers an adequate method of stopping an in-line roller skate, however, it does not allow a skater the free use of his hands which are necessary to maintain balance. In addition, a cantilever application of a brake force as defined with this structure may place an undue force on the central bearing in the roller skate.

SUMMARY OF THE INVENTION

A primary object of the present invention is to provide a skater with the free use of the hands while at the same time providing a skater with ability to hydraulically brake the rollers of an in-line roller skate.

In the present in-line roller skate a hydraulic braking system is provided for each roller of a plurality of rollers located in a housing one behind the other along a line of directional travel of the skate. Each roller is located between and secured to first and second rotors. An axle extends through bearings located in hubs of the first and second rotors to position the rollers in the housing. First and second pistons are correspondingly retained in the housing at a location in a line perpendicular to the first and second rotors. An actuation piston located in the housing is connected by first and second passageways to the first and second pistons. A boot fixed to the housing has a collar which is pivotally located adjacent an opening of the boot. The collar engages an ankle of a skater for retaining the boot on a foot. When the skater when traveling in a forward direction the weight of the skater is transmitted through a center of gravity located toward the front end of the housing. When the skater moves toward an erect position the center of gravity is shifted from the front end toward the rear end of the housing. As the skater moves toward the erect position, the collar pivots with respect to the boot such that linkage which extends from the collar supplies an input force to the actuation piston. The input force moves the actuation piston within the housing to create a hydraulic pressure which is simultaneously supplied to the first and second passageways to move the first and second pistons into engagement with the first and second rotors to brake the plurality of rollers.

An advantage of this hydraulic brake system resides in the ability to provide first and second pistons with an input force to bring first and second rotors into engagement with a roller brake the roller by a skater moving to an erect position.

A further advantage of this hydraulic brake system resides in the ability of a skater to bring an in-line roller to a smooth stop.

DETAILED DESCRIPTION

Throughout this specification where appropriate identical components are identified by the same number in the various Figures of the drawings and in instances where necessary to provide a better understanding a ' has been added.

Figure 1:
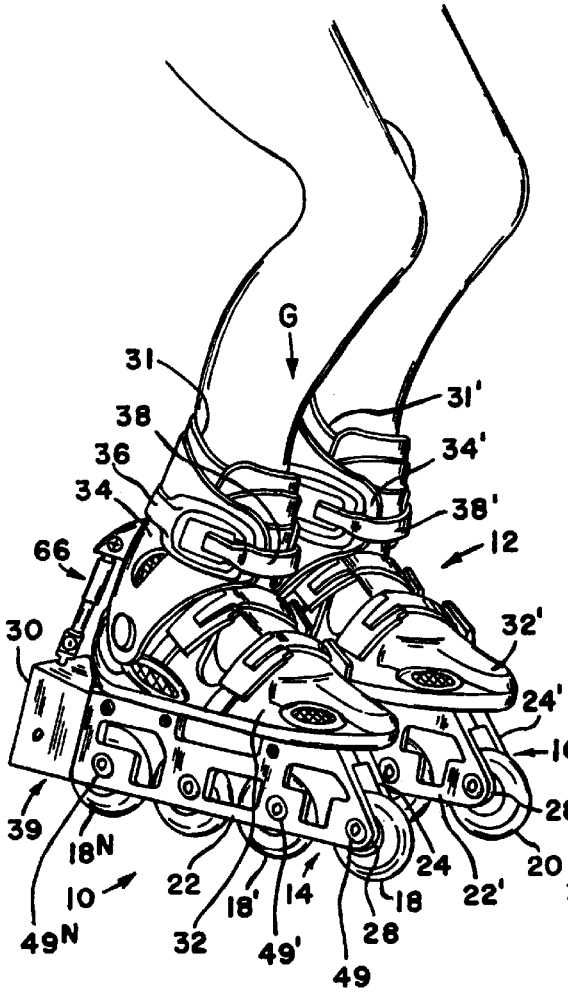
FIG. 1 is a perspective illustration of an in-line skate made according to the invention disclosed herein with a skater in a skating position with knees and ankle slightly bent with respect to the bottom of a foot.
Figure 2:
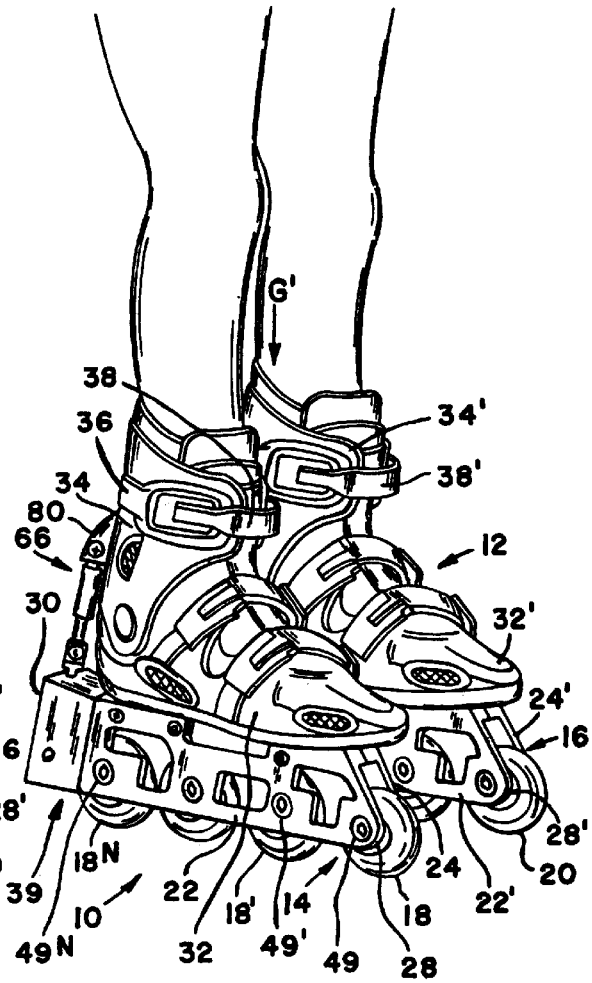
FIG. 2 is a perspective illustration of the in-line skate of FIG. 1 with the a leg of the skater in a straight line when the skater is in an erect position.

FIGS. 1 and 2 illustrate a pair of in-line roller skates 10 and 12 having a braking system 39 made according to the principals of the present invention. As is common for an in-line roller skate, roller skate 10 has a housing 14 with a first plurality of rollers 18,18', . . . 18" retained between first 22 and second 24 rails and skate 12 has a housing 16 with a second plurality of rollers 20,20', . . . 20" retained between first 22' and second 24' rails. The first plurality of rollers 18,18', . . . 18" and second plurality of rollers 20,20', . . . 20" are located one behind the other, along a line of directional travel of the skate, from a front end 28 to a rear end 30 of housings 14 and 16. Boots 32,32' which are attached to the top of the housings 14 and 16 of skates 10 and 12 each have a collar 34,34' which engages a leg of a skater through straps 36,36' and clamps 38,38' in a manner as shown in FIGS. 1 and 2. FIG. 1 illustrates a skater is moving in a forward direction with his knees and ankles slightly bent. In this position, the weight of the skater is transmitted through a center of gravity G into a location toward the front end 28 of the housings 14 and 16 with his hands are free to move and assist in balancing on the first and second plurality of rollers 18,18', . . . 18$^n$ and 20,20', . . . 20$^n$. Freedom of hand movement is of particular importance when a skater desires speed as his hands freely move in a pumping fashion to increase speed. When the skater desires to stop moving in a forward direction, the skater activates the brake system 39 of the present invention by merely assuming an erect position through the straightening his legs to establish a different center of gravity G' as shown in FIG. 2.

In more particular detail of the brake system 39,39' for skates 10 and 12 are identical and as a result only the brake system 39 for skate 10 will be described in detail.

Figure 7:
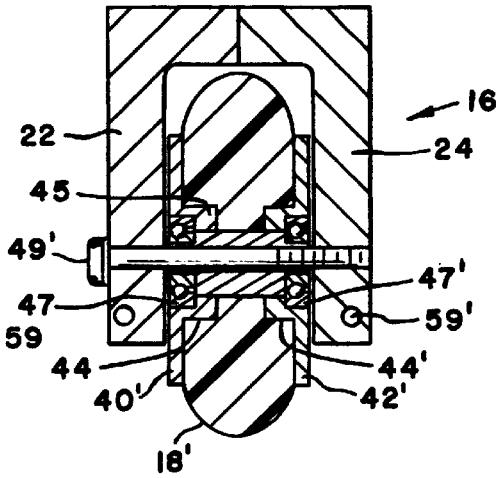
FIG. 7 is a sectional view taken along line 7—7 of FIG. 3 showing the relationship of a roller, first and second rotors and first and second bearings.

Skate 10 has a housing 14 made by joining a first rail 22 with a second rail 24 for retaining a plurality of rollers 18,18', . . . 18$^n$ and the brake system 39. The brake system 39 includes first 40 and second 42 rotors, see FIG. 7, which are fixed to each of the rollers 18,18', . . . 18$^n$ by a knurled surface 44 engagement with hub 45 associated roller 18,18', . . . 18$^n$. An axle 49', which extends through a sleeve or bushing member 45 for bearings 47,47' of rotors 40,42, is retained by rails 22 and 24 to position first 40' rotor, roller 20' and second rotor 42', hereinafter called a roller assembly, in housing 16. Similar, axles 49, . . . 49$^n$ retain the remainder of roller assemblies for roller 20, . . . 20$^n$ in housing 16.

Figure 6:
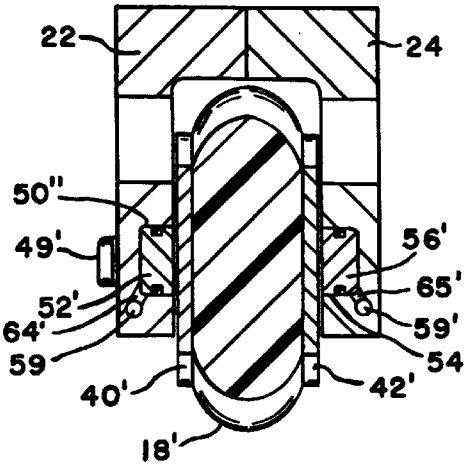
FIG. 6 is a sectional view taken along line 6—6 of FIG. 3 showing the relationship of a roller, first and second rotors and first and second pistons during a brake application.
Figure 8:
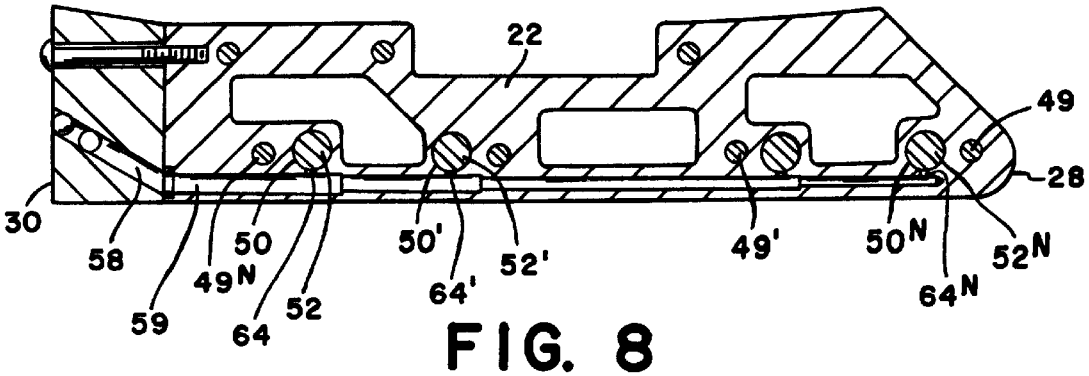
FIG. 8 is a sectional view taken along line 8—8 of FIG. 4 showing a flow path for the actuation pistons located on one side of the various rotors in the in-line skate

Rail 22 has a first series of bores 50,50', . . . 50$^n$, see FIG. 8, for retaining a first series of pistons 52,52', . . . 52$^n$ in perpendicular alignment with first rotors 40,40', . . . 40$^n$ fixed to rollers 18,18', . . . 18$^n$ while rail 24 has a second series of bores (only bore 54" being shown in FIG. 6) for retaining a second series of pistons (only piston 56' being shown in FIG. 6) in perpendicular alignment with rotors (only rotor 42' being shown in FIG. 6) fixed to rollers 18,18', . . . 18$^n$. The first series of bores 50,50', . . . 50$^n$ are connected by a first passageway 59 to passageway 58 of a bore 60 located adjacent the rear 30 of rail 22 while the second series of bores 54,54', . . . 54$^n$ in rail 24 are connected by a second passageway 59' to passageway 58' connected to bore 60.

Figure 5:
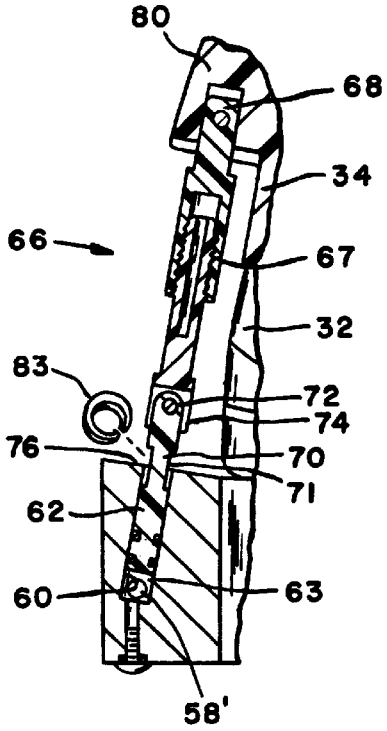
FIG. 5 is a sectional view taken along line 5—5 of FIG. 4 showing linkage attached to a collar for moving an actuation piston to pressurize fluid which is supplied to first and second piston to effect a brake application and a locking means which is selective secured to the linkage to hold the actuation piston in a fixed position to prevent an input force from being communicated to move the actuation piston.

An actuation piston 62 as shown in FIG. 5 is located in bore 60 to define a closed chamber 63 within housing 16. Actuation piston 62 is about the same size of the first series of pistons 52,52', . . . 52$^n$ and second series of pistons 56,56', . . . 56$^n$ while the size of the passageway 59,59' which connect passageways 58,58' to orifices 64,64', . . . 64$^n$ associated with the first series of bores 52,52', . . . 52$^n$ and passageway 59' which connect passageway 58' to orifice 65,65', . . . 65$^n$ associated with the second series of bores 54,54', . . . 54$^n$ are the same size and as a result a same fluid pressure is supplied to move each of the first rotors 40,40', . . . 40$^n$ and second rotors 42,42', . . . 42$^n$ into engagement with rollers 18,18', . . . 18$^n$ to effect a brake application. Under some circumstances passageways 59,59' may vary with in size, with the passageways decreasing in size from orifices 64,65 to orifices 64$^n$,65$^n$ to deliver a proportionally higher pressure hydraulic fluid to pistons 52$^n$,56$^n$ which are the furthest from chamber 64 and assist in the synchronization of a brake application.

Figure 4:
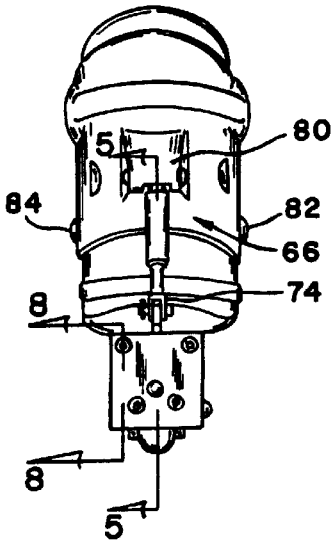
FIG. 4 is an end view of an in-line skate shown in FIG. 2.
Figure 3:
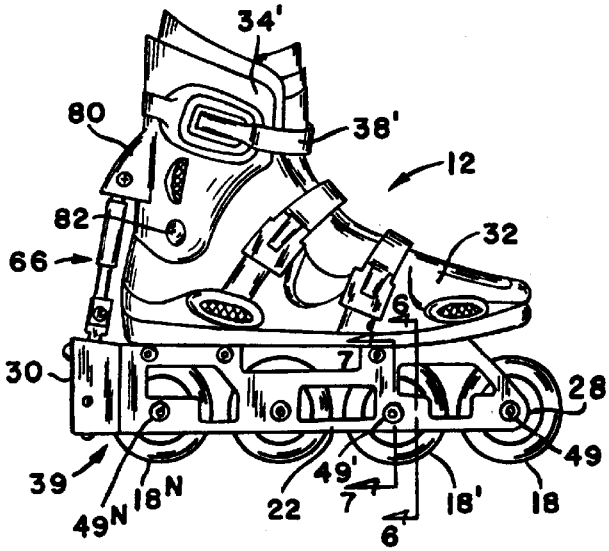
FIG. 3 is a side view of an in-line skate shown in FIG. 2.

A linkage means 66, as best shown in FIGS. 3, 4 and 5, has a first shaft 68 connected to frame 80 of collar 34 which is attached to boot 32 by pivot pins 82,84. A second shaft 70 which is connected to the actuation piston 62 is joined to the first shaft 68 through a first pin 72 that extends through a yoke means 74. Yoke means 74 is designed to be threaded 67 onto shaft 68 to adjust or establish the length from frame 80 of collar 34 to actuation piston 62. A clip 83, shown in space in FIG. 5, is designed to be placed in slot 71 of shaft 70 to engage shoulder 76 of housing 16 and hold shaft 70 in a fixed position. With shaft 70 held in a stationary position, actuation piston 62 is correspondingly held in a stationary position within bore 60 and the development of hydraulic pressure is prevented as will be discussed later.

In some instances the locking means for shaft 70 may be established by inserting a second pin in a cross bore in shaft 70. The second pin engaging shoulder 76 to hold shaft 70 in a stationary position on engagement with housing 16 when it is desired to disengage the brake system 39

Mode of Operation

When a skater desires to go skating, he places his right foot in opening 31 of boot 32 and tightens strap 34 by clamp 36 to secure skate 10 to his left leg and performs a similar procedure with respect to right foot to secure skate 12 to his left leg. The skater stands up and with his knees slightly bent moves his legs to move in a forward direction, as shown in FIG. 1. When a skater is traveling in a forward direction has a center of gravity is transmitted through boots 32,32' into a location G toward the front end 28,28' of housings 14 and 16. At the same time collar 34,34' pivoted on pins 82,84 such that shaft 68 of linkage means 66 attached to frame 80 moves actuation pistons 62 to an up position as shown in FIG. 1.

When a skater desires to stop his forward motion, the skater moves toward an erect position by straightening his legs to a position, as illustrated in FIG. 2. As the skater moves toward the erect position, the center of gravity is shifted to a second position G' toward the rear 30 of housings 14 and 16. When the legs of the skater are straightened, collars 34,34' pivot on pins 82,84 to impart a force through shafts 68 attached to frames 80 which move actuation pistons 62 in bores 60 to develop a hydraulic force or pressure in the fluid in chamber 63. The hydraulic pressure is transmitted to the first series of pistons 52,52', . . . 52$^n$ and second series of pistons 56,56', . . . 56$^n$ which correspondingly act the first 40 and second 42 rotors associated with the first plurality of rollers 18,18', . . . 18$^n$ and the first 40' and second 42' rotors associated with the second plurality of rollers 20,20', . . . 20$^n$ to effect a brake application and stop the forward motion of the skater. As long as the skater remains in an upright position, the hydraulic fluid holds the first series of pistons 52,52', . . . 52$^n$ and second series of pistons 56,56', . . . 56$^n$ in engagement with the first 40 and second 42 rotors associated with the first plurality of rollers 18,18', . . . 18$^n$ and the second plurality of rollers 20,20', . . . 20$^n$ to allow the skate to remain in a stationary location. Once the skater bends his knees, collars 34,34' again pivot to bring linkage means 66 to a location G, as illustrated in FIG. 1, where actuation pistons 62 no longer pressurize fluid in chamber 63 and the first series of pistons 52,52', . . . 52$^n$ and second series of pistons 56,56', . . . 56$^n$ disengagement from the first 40 and second 42 rotors associated with the first plurality of rollers 18,18', . . . 18$^n$ and the second plurality of rollers 20,20', . . . 20$^n$ to allow forward motion.

Should a skater desire to disengage the brake system 39 to allow backward skating with the in-line skate 10 and 12, clip 83 is inserted in slot 71 on shaft 70. Clip 83 engages shoulder 76 of the housing 16 surrounding bore 60 to lock shaft 70 in a stationary position such that an input force applied to shaft 68 through the pivoting of collar 34,34' is carried into housing 16 and actuation piston 62 held in a stationary position within bore 60 to prevent the development of hydraulic pressure. When the skater has finished his performance, clip 83 is removed from shaft 70 and the braking system 39 is reactivated.

I claim:

1. A braking system for an in-line roller skate, said roller skate having a housing with a plurality of rollers located one behind the other along a line of directional travel of the skate from a front end to a rear end, said roller skate comprising:

first and second rotors each having a hub which is keyed to at least one of said plurality of rollers;

first and second pistons retained in said housing and located in a line perpendicular to said first and second rotors;

an actuation piston located in said housing and connected to said first and second pistons;

a boot secured to said housing and having a collar adjacent an opening of said boot, said collar engaging an ankle of a skater for retention of said boot on a foot; and linkage extending from said collar to said actuation piston, said skater when traveling in a forward direction having a center of gravity through which weight is transmitted from said boot into a location toward said front end of said housing, said center of gravity being shifted by said skater from said front end toward said rear end of said housing by said skater moving toward an erect position to provide said linkage with an input force which moves said actuation piston to create a hydraulic pressure which is simultaneously supplied to move said first and second pistons into engagement with said first and second rotors to brake said one of plurality of rollers.

2. The brake system as recited in claim 1 wherein said linkage is attached to said collar, said collar pivoting with respect to said boot as said skater moves toward an upright position to develop said input force.

3. The brake system as recited in claim 1 wherein said linkage includes a first shaft connected to said collar, a second shaft connected to said actuation piston, said first shaft being joined to said second shaft through a first pin that extends through yoke means.

4. The brake system as recited in claim 3 wherein said linkage includes adjustment means for changing a length of travel required to move said collar to provide an input force to said actuation piston.

5. The brake system as recited in claim 4 wherein said linkage includes locking means to retain said actuation piston in a stationary position when said skater is in an upright position.

6. A braking system for an in-line roller skate, said roller skate having a housing with a plurality of rollers located one behind the other along a line of directional travel of the skate from a front end to a rear end, said roller skate comprising:

first and second rotors each having corresponding first and second hubs which are keyed to at least one of said plurality of rollers;

first and second pistons retained in said housing and located in a line perpendicular to said first and second rotors;

an actuation piston located in said housing and connected to said first and second pistons;

a boot secured to said housing and having a collar adjacent an opening of said boot, said collar engaging an ankle of a skater for retention of said boot on a foot; and linkage having a first shaft connected to said collar, a second shaft connected to said actuation piston and a yoke and pin joint for connecting said first shaft with said second shaft, said skater when traveling in a forward direction having a center of gravity through which weight is transmitted from said boot into a location toward said front end of said housing, said center of gravity being shifted by said skater from said front end toward said rear end of said housing by said skater moving toward an erect position to provide said linkage with an input force which moves said actuation piston to create a hydraulic pressure which is simultaneously supplied to move said first and second pistons into engagement with said first and second rotors to brake said one of plurality of rollers.

7. The brake system as recited in claim 6 wherein said locking means is a clip which engages said yoke and said housing to hold said actuation piston in a stationary position.

8. The brake system as recited in claim 7 wherein said collar includes a strap having a frame joined to said boot at first and second pivot pins, said linkage being connected to said frame such that on said skater moving toward said erect position said frame pivots on said first and second pins to impart said input force to move said linkage and develop said hydraulic pressure.

9. The brake system as recited in claim 7 wherein said collar pivots with respect to said boot as said skater moves toward an upright position to develop said input force.

10. The brake system as recited in claim 9 wherein said housing includes first and second passages for communicating hydraulic pressure from said actuation piston to said first and second pistons associated with said plurality of rollers.

11. The brake system as recited in claim 10 wherein said housing includes a plurality of orifices associated with said first and second passages whereby a different volume of fluid containing said hydraulic pressure is presented to first and second pistons associated with each of said plurality of rollers.

12. The brake system as recited in claim 11 wherein said linkage includes means to modify the input force applied to said actuation piston.

13. The brake system as recited in claim 12 wherein said means to modify includes locking means to inhibit the communication of said input force to said actuation piston.

14. The brake system as recited in claim 13 wherein said locking means is a pin which extends through a shaft that connects said collar with said actuation piston and engages said housing to hold said actuation piston in a stationary position.

15. The brake system as recited in claim 14 wherein said collar includes a strap having a frame joined to said boot at first and second pivot pins, said linkage being connected to said frame such that on said skater moving toward said erect position said frame pivots on said first and second pins to impart said input force to move said linkage and develop said hydraulic pressure.

16. A braking system for an in-line roller skate, said roller skate having a housing with a plurality of rollers located one behind the other along a line of directional travel of the skate from a front end to a rear end, said roller skate comprising:

a first rotor having a first hub and a second rotor having a second hub fixed to each of said plurality of rollers;

first and second pistons retained in said housing and located in a line perpendicular to each of said first and second rotors;

an actuation piston located in said housing and connected to each of said first and second pistons;

a boot secured to said housing and having a collar adjacent an opening of said boot, said collar engaging an ankle of a skater for retaining said boot on a foot; and linkage extending from said collar to said actuation piston, said skater when traveling in a forward direction having a center of gravity through which the weight of said skater is transmitted from said boot into a location toward said front end of said housing, said center of gravity being shifted by said skater from said front end toward said rear end of said housing by said skater moving toward an erect position to provide said linkage with an input force which moves said actuation piston to create a hydraulic pressure which is simultaneously supplied to move of said first and second pistons into engagement with said first and second rotors to brake said plurality of rollers.

* * * * *